US007684751B2

(12) United States Patent
Posamentier

(10) Patent No.: US 7,684,751 B2
(45) Date of Patent: Mar. 23, 2010

(54) RADIO FREQUENCY IDENTIFICATION APPARATUS, SYSTEM AND METHOD ADAPTED FOR SELF-JAMMER CANCELLATION

(75) Inventor: Joshua Posamentier, Oakland, CA (US)

(73) Assignee: Intel Corporation, Santa Clara, CA (US)

( * ) Notice: Subject to any disclaimer, the term of this patent is extended or adjusted under 35 U.S.C. 154(b) by 679 days.

(21) Appl. No.: 11/527,985

(22) Filed: Sep. 26, 2006

(65) Prior Publication Data

US 2008/0081551 A1 Apr. 3, 2008

(51) Int. Cl.
*H04K 3/00* (2006.01)

(52) U.S. Cl. ..... 455/1; 455/283; 455/296; 398/39; 398/40

(58) Field of Classification Search ..... 455/1, 455/414.1, 414.278, 88, 24, 69, 522, 70, 455/73, 78, 91, 283, 296, 414.2, 83, 85; 398/39, 398/40

See application file for complete search history.

(56) References Cited

U.S. PATENT DOCUMENTS 4,528,656 A * 7/1985 Morais ..... 370/281
5,995,566 A * 11/1999 Rickard et al. ..... 375/346
7,155,179 B1 * 12/2006 Rothenberg ..... 455/114.2
7,221,900 B2 * 5/2007 Reade et al. ..... 455/1
2004/0066845 A1 * 4/2004 Leith et al. ..... 375/238
2004/0111202 A1 * 6/2004 Mailer ..... 701/50
2006/0097705 A1 * 5/2006 Cheung et al. ..... 323/222
2006/0234670 A1 * 10/2006 Blaker et al. ..... 455/343.1
2007/0085579 A1 * 4/2007 Wallberg et al. ..... 327/156
2007/0249314 A1 * 10/2007 Sanders et al. ..... 455/296

* cited by examiner

*Primary Examiner*—Duc Nguyen
*Assistant Examiner*—Dominic E Rego
(74) *Attorney, Agent, or Firm*—James S. Finn

(57) ABSTRACT

An embodiment of the present invention provides an apparatus, comprising a radio frequency identification transceiver adapted for self jammer suppression. The transceiver may further comprise a phase shifter and variable attenuator/variable amplifier adjusted to minimize the power injected into a receive chain by the self jammer. In an embodiment of the present invention the present transceiver may further comprise at least one RF peak power detector to determine the power injected into the receive chain.

17 Claims, 2 Drawing Sheets

RADIO FREQUENCY IDENTIFICATION APPARATUS, SYSTEM AND METHOD ADAPTED FOR SELF-JAMMER CANCELLATION

BACKGROUND

Full duplex RFID systems may need to deal with a high amplitude self jammer resulting from a powerful transmit signal either leaking from one antenna to another in a bi-static antenna system or being reflected from antenna because of its return loss in a monostatic antenna system. This self-jammer is always present during both transmit and receive periods although it may only be during receive periods that compression or desensitization of the receiver matters. While there are situations when there are other interferers that may occur at higher amplitudes, removing or supressing the self jammer will always improve system performance.

Thus, a strong need exists for full duplex radio frequency identification apparatuses, systems and methods adapted for self-jammer suppression.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
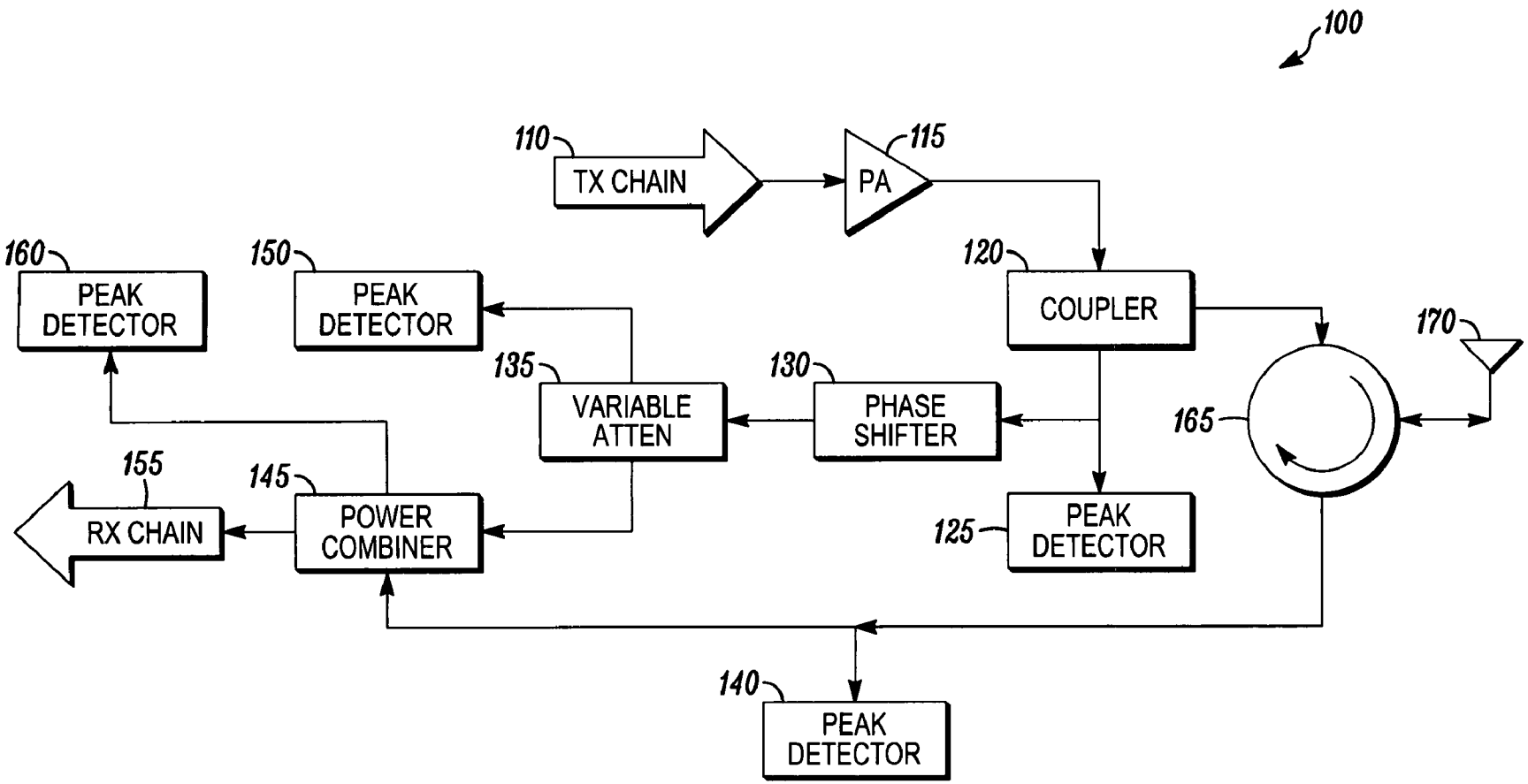
FIG. 1 is a circuit diagram illustrating the transceiver in a radio frequency identification apparatus adapted for self-jammer cancellation or suppression of one embodiment of the present invention.

It will be appreciated that for simplicity and clarity of illustration, elements illustrated in the figures have not necessarily been drawn to scale. For example, the dimensions of some of the elements are exaggerated relative to other elements for clarity. Further, where considered appropriate, reference numerals have been repeated among the figures to indicate corresponding or analogous elements.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

An algorithm, technique or process is here, and generally, considered to be a self-consistent sequence of acts or operations leading to a desired result. These include physical manipulations of physical quantities.

Embodiments of the present invention may include apparatuses for performing the operations herein. An apparatus may be specially constructed for the desired purposes, or it may comprise a general purpose computing device selectively activated or reconfigured by a program stored in the device. Such a program may be stored on a storage medium, such as, but not limited to, any type of disk including floppy disks, optical disks, compact disc read only memories (CD-ROMs), magnetic-optical disks, read-only memories (ROMs), random access memories (RAMs), electrically programmable read-only memories (EPROMs), electrically erasable and programmable read only memories (EEPROMs), magnetic or optical cards, and capable of being coupled to a system bus for a computing device.

The processes and displays presented herein are not inherently related to any particular computing device or other apparatus. Various general purpose systems may be used with programs in accordance with the teachings herein, or it may prove convenient to construct a more specialized apparatus to perform the desired method. The desired structure for a variety of these systems will appear from the description below. In addition, embodiments of the present invention are not described with reference to any particular programming language. It will be appreciated that a variety of programming languages may be used to implement the teachings of the invention as described herein. In addition, it should be understood that operations, capabilities, and features described herein may be implemented with any combination of hardware (discrete or integrated circuits) and software.

as in a cause and effect relationship).

Use of the terms "coupled" and "connected", along with their derivatives, may be used. It should be understood that these terms are not intended as synonyms for each other. Rather, in particular embodiments, "connected" may be used to indicate that two or more elements are in direct physical or electrical contact with each other. "Coupled" my be used to indicated that two or more elements are in either direct or indirect (with other intervening elements between them) physical or electrical contact with each other, and/or that the two or more elements co-operate or interact with each other (e.g. as in a cause and effect relationship).

In an embodiment of the present invention, full duplex Radio Frequency Identification (RFID) systems such as, but not limited to, today's UHF (900 MHz) RFID systems may be based on standards such as EPC Global's C1G2, the various ISO18000-6ABC standards, and the iPX protocol and may have to deal with a high amplitude self jammer resulting from powerful transmit signals either leaking from one antenna to another in a bi-static antenna system or from the antenna's return loss in a monostatic antenna system. This self-jammer is always present during both transmit and receive periods although it is only during Rx periods that compression of or desensing the receiver matters. In the receive mode, the jammer may be a continuous wave tone down at −16 dBc to −26 dBc in a typical RFID system from the peak carrier. In a 1 W system, this equates to +4 to +14 dBm at the system port. An embodiment of the present invention suppresses the self jammer by as much as 40 dB.

Turning now to the figures, FIG. 1 is a circuit diagram 100 depicting the transceiver in a radio frequency identification apparatus adapted for self-jammer cancellation of one embodiment of the present invention. Most effective for the present invention, although not limited in this respect, is a self jammer that is a continuous wave tone. An embodiment of the present invention provides a signal that incorporates a forward power tap 165 used for transmit power control after a power amplifier 115 and coupler 120. The power tap 165 is shown connected to antenna 170 and receive chain 155 via power combiner 145. Further, in an embodiment of the present invention and not limited in this respect, the forward power should be much greater than the reverse power and the phase noise and amplitude noise of the transmit chain 110 is cancelable with the signal of interest (the tag response) considerably lower (←60 dB) than the self jammer as well as being offset by 10's of kHz in the frequency domain. Importantly, suppressing the self-jammer in no way effects the signal response from the RFID tag itself.

Through a choice of algorithms including, but not limited to, simple dual proportional-integral-derivative (PID) control loops, adaptive perturbation control loops, or simple analog domain filtered feedback loops, the phase shifter 130 and variable attenuator/amplifier 135 are adjusted to minimize power at peak detector 160. This is total spectral power rather than envelope peak power. Not all peak detectors are necessary for an individual method and the following is but one illustration of one embodiment of the present invention, and may be utilized as follows. The peak detector 125 simply monitors and provides a feedback path for transmit power control. The peak detector 140 provides a reference level on an incoming jammer or other loud interferer. The peak detector 150 allows for initial power level matching so as to accelerate a perturbation loop convergence solution. Ultimately, minimizing the power at the detector 160 minimizes the self jammer injected into the receive chain 155 which receives input from power combiner 145 and which results in less desensitization and saturation or compression, thereby yielding a superior signal to noise ration (SNR) and reducing the effects of a poorly matched antenna or an antenna in a challenging environment with large amplitude reflections.

Removing the self jammer from the receive chain reduces intermodulation distortion present when other large interferers are present. It may also reduce desensitization in the receive chain and allow for an ultimately lower noise system which can then allow the circuit to be more sensitive. This is critical for the next generation of RFID systems.

Figure 2:
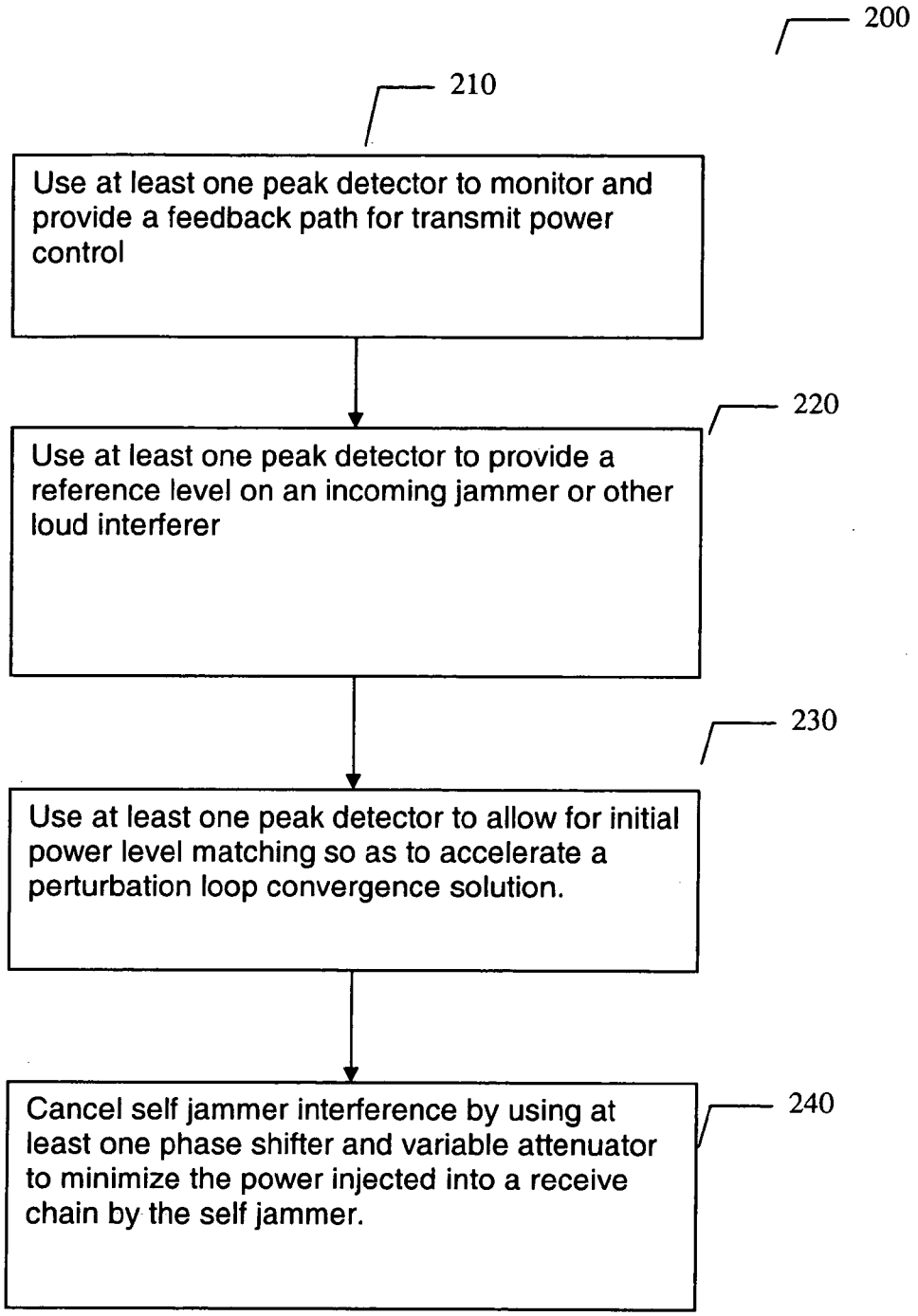
FIG. 2 illustrates a flowchart of the method according to one embodiment of the present invention.

Looking now at FIG. 2, shown generally as 200, a further embodiment of the present invention provides a method, comprising cancelling self jammer interference in a radio frequency identification transceiver by using at least one phase shifter and variable attenuator to minimize the power injected into a receive chain by the self jammer 240. This present method may use at least one peak detector to monitor and provide a feedback path for transmit power control 210, at least one peak detector to provide a reference level on an incoming jammer or other loud interferer 220 and at least one peak detector to allow for initial power level matching so as to accelerate a perturbation loop convergence solution 230. The self jammer may be controlled by using a dual PID control loop algorithm or adaptive perturbation control loops and a forward power tap may provide for transmit power control; although, the present invention is not limited in this respect. In an embodiment of the present invention, the present method may include using the apparatus in a full duplex radio frequency identification system.

In yet another embodiment of the present invention is provided a machine-accessible medium that provides instructions, which when accessed, cause a machine to perform operations comprising, cancelling self jammer interference in a radio frequency identification transceiver by using at least one phase shifter and variable attenuator/variable amplifier to minimize the power injected into a receive chain by the self jammer. The machine-accessible medium of the present invention may further comprise the instructions causing the machine to perform operations further comprising using at least one peak detector to determine the power injected into the receive chain.

Still another embodiment of the present invention provides a radio frequency identification (RFID) system, comprising a radio frequency identification (RFID) transceiver adapted for self jammer cancellation and an RFID tag in communication with the RFID transceiver, wherein the transceiver further comprises a phase shifter and variable attenuator adjusted to minimize the power injected into a receive chain by the self jammer.

An embodiment of the present invention also provides a circuit, comprising a forward power tap receiving transmit chain signals via a power amplifier and coupler; and outputting a receive chain via a power combiner, a phase shifter and variable attenuator/variable amplifier connected to the coupler and the power combiner; and at least one RF power detector to determine the power injected into the receive chain so as to enable self jammer suppression. An omni-directional antenna may be connected to the power tap.

While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

I claim:

1. An apparatus, comprising:

a radio frequency identification transceiver configured to use self jammer suppression;

wherein said transceiver further comprises a phase shifter and variable attenuator/variable amplifier adjusted to minimize the power injected into a receive chain by said self jammer and at least one RF power detector to determine the power injected into said receive chain; and a plurality of peak detectors with at least one RF peak detector to monitor and provide a feedback path for transmit power control, at least one RF peak detector to provide a reference level on an incoming jammer or other loud interferer and at least one peak detector to allow for initial power level matching so as to accelerate a perturbation loop convergence solution.

2. The apparatus of claim 1, wherein said apparatus uses a dual proportional-integral-derivative (PID) control loop algorithm to control self jammer cancellation.

3. The apparatus of claim 1, wherein said apparatus uses adaptive perturbation control loops to control self jammer cancellation.

4. The apparatus of claim 1, further comprising a forward power tap used for transmit power control.

5. The apparatus of claim 1, wherein said apparatus is incorporated into a full duplex radio frequency identification system.

6. A storage medium having stored thereon instructions, that, when executed by a computing platform results in:

suppressing self jammer interference in a radio frequency identification transceiver by using at least one phase shifter and variable attenuator/variable amplifier to minimize the power injected into a receive chain by said self jammer;

using at least one RF power detector to determine the power injected into said receive chain; and using a plurality of peak detectors with at least one RF peak detector to monitor and provide a feedback path for transmit power control, at least one RF peak detector to provide a reference level on an incoming jammer or other loud interferer and at least one peak detector to allow for initial power level matching so as to accelerate a perturbation loop convergence solution.

7. The storeage medium of claim 6, further comprising said instructions causing said machine to perform operations further comprising controlling self jammer cancellation with a dual proportional-integral-derivative (PID) control loop algorithm.

8. The storeage medium of claim 6, further comprising said instructions causing said machine to perform operations further comprising controlling self jammer suppression with adaptive perturbation control loops.

9. The storeage medium of claim 6, further comprising said instructions causing said machine to perform operations further comprising using a forward power tap for transmit power control.

10. The storeage medium of claim 6, further comprising said instructions causing said machine to perform operations further comprising using said apparatus in a full duplex radio frequency identification system.

11. A radio frequency identification (RFID) system, comprising:

a radio frequency identification (RFID) transceiver configured to use self jammer cancellation;

an RF ID tag in communication with said RFID transceiver;

wherein said transceiver further comprises:

a phase shifter and variable attenuator/variable amplifier adjusted to minimize the power injected into a receive chain by said self jammer;

at least one peak detector to monitor and provide a feedback path for transmit power control;

at least one peak detector to provide a reference level on an incoming jammer or other loud interferer; and at least one peak detector to allow for initial power level matching so as to accelerate a perturbation loop convergence solution.

12. The system of claim 11, wherein said apparatus uses a dual PID control loop algorithm or adaptive perturbation control loops to control self jammer suppression.

13. The system of claim 11, wherein said system is a full duplex radio frequency identification system.

14. A circuit, comprising:

a forward power tap receiving transmit chain signals via a power amplifier and coupler and outputting a receive chain via a power combiner;

a phase shifter and variable attenuator/variable amplifier connected to said coupler and said power combiner;

at least one RF peak detector to determine the power injected into said receive chain so as to enable self jammer suppression; and at least one peak detector to monitor and provide a feedback path for transmit power control, at least one peak detector to provide a reference level on an incoming jammer or other loud interferer and at least one peak detector to allow for initial power level matching so as to accelerate a perturbation loop convergence solution.

15. The circuit of claim 14, further comprising an omnidirectional antenna connected to said power tap.

16. The circuit of claim 14, wherein said circuit uses adaptive perturbation control loops to control self jammer suppression.

17. The circuit of claim 14, wherein said circuit uses a dual PID control loop algorithm to control self jammer suppression.

* * * * *